United States Patent [19]

Chivinsky et al.

[11] 4,099,966

[45] Jul. 11, 1978

[54] AUSTENITIC STAINLESS STEEL

[75] Inventors: Joseph A. Chivinsky, Sarver; Harry E. Deverell, Natrona Heights, both of Pa.

[73] Assignee: Allegheny Ludlum Industries, Inc., Pittsburgh, Pa.

[21] Appl. No.: 746,968

[22] Filed: Dec. 2, 1976

[51] Int. Cl.[2] ..... C22C 38/16; C22C 38/42; C22C 38/58

[52] U.S. Cl. ..... 75/125; 75/122; 75/128 A; 75/128 E; 75/128 G; 75/128 N; 75/128 T; 75/128 V; 75/128 W

[58] Field of Search ..... 75/125, 122, 128 A, 75/128 N, 128 W, 128 E, 128 T, 128 V, 128 G; 148/38

[56] References Cited

U.S. PATENT DOCUMENTS

| | | | |
|---|---|---|---|
| Re. 26,903 | 6/1970 | Jennings | 75/128 R |
| Re. 28,772 | 4/1976 | Denhard, Jr. et al. | 75/128 A |
| 2,553,330 | 5/1951 | Post et al. | 75/128 E |
| 3,171,738 | 3/1965 | Renshaw et al. | 75/128 N |
| 3,311,511 | 3/1967 | Goller | 75/128 R |
| 3,561,953 | 2/1971 | Niimi et al. | 75/128 W |
| 3,645,725 | 2/1972 | Denhard, Jr. et al. | 75/128 A |
| 3,726,668 | 4/1973 | Baümel | 75/128 A |
| 3,854,937 | 12/1974 | Muta et al. | 75/128 W |
| 3,854,938 | 12/1974 | Baybrook et al. | 75/128 W |
| 4,007,038 | 2/1977 | Deverell | 75/122 |

*Primary Examiner*—Arthur J. Steiner
*Attorney, Agent, or Firm*—Vincent G. Gioia; Robert F. Dropkin

[57] ABSTRACT

A hot workable austenitic stainless steel having superior pitting and crevice corrosion resistance to the chloride ion. The steel consists essentially of, by weight, from 19 to 23% chromium, 5 to 16% nickel, 3 to 5% molybdenum, 2.5 to 15% manganese, up to 0.01% sulfur, up to 0.1% of at least one element from the group consisting of cerium, calcium and magnesium, nitrogen from 0.2% up to its solubility limit, up to 0.1% carbon, up to 1% silicon, up to 3% copper, up to 1% columbium, up to 0.3% vanadium, up to 0.3% titanium, balance essentially iron.

15 Claims, No Drawings

AUSTENITIC STAINLESS STEEL

The present invention relates to an austenitic stainless steel.

Contact between metallic surfaces and chloride ions often results in a type of corrosion known as pitting; and one which is of a particularly serious nature in environments such as sea water, those encountered in certain chemical processes and pulp and paper plant media. While most forms of corrosion proceed at a predictable and uniform rate, pitting is characterized by its unpredictability. Pitting is concentrated in specific and unpredictable parts of the metallic surface; and once initiated, accelerates itself by concentrating the chloride ion into the initiated pit. Throughout this specification, "pitting" is intended to include both pitting and crevice corrosion. When a crevice is present through design or deposits, the type of attack is better described as crevice corrosion. Crevice corrosion is, however, commonly referred to as pitting.

Described herein is an austenitic alloy with a high level of pitting resistance; one characterized by a weight loss of one part or less in 10,000, in a 72 hour room temperature 10% ferric chloride, 90% distilled water rubber band test. Included therein are specific additions of chromium and, in particular, molybdenum, as they enhance pitting resistance. However, as chromium and molybdenum are ferrite promoting elements, the alloy must contain a sufficient amount of austenite promoting elements, to insure formation of an austenitic steel. Such elements include nickel, manganese (up to a certain level), copper, and nitrogen which also enhances pitting resistance. Austenitic steels have received greater acceptance than ferritic and martensitic steels because of their generally desirable combination of properties which include ease of welding, excellent toughness and general corrosion resistance.

The alloy described herein is also characterized as being one of improved hot workability. The improvement is attained by insuring that the alloy is fully austenitic and has a very low sulfur content. Low sulfur is preferably attained through additions of cerium, calcium and/or magnesium. An alloy is deemed to be fully austenitic within the confines of the subject invention when it has only traces (a few percent at most) of ferrite along with normal steelmaking inclusions and possibly some sigma or chi phase.

Certain embodiments of the alloy are additionally characterized as being especially suitable for use where welding is involved. Chemistries of these embodiments are carefully balanced to include a sufficient quantity of those elements which increase the alloy's solubility for nitrogen, and in particular sufficient amounts of manganese.

A number of prior art alloys have some similarities to that of the subject application, but nevertheless are significantly different therefrom. With regard thereto, particular attention is directed to U.S. Pat. Nos. 2,553,330; 2,894,833; 3,171,738; 3,311,511; 3,561,953; 3,598,574; 3,726,668; 3,854,938; Re. 26,903; and Re. 28,772, and U.S. patent application Ser. No. 571,460 (filed Apr. 25, 1975, now U.S. Pat. No. 4,007,038). Significantly, not one of the references discloses the alloy of the subject application. Not one of them disclose the combination of elements whose synergistic effect gives the subject alloy its unique combination of properties.

It is accordingly an object of the present invention to provide an austenitic stainless steel having a combination of elements whose synergistic effect gives it a highly desirable combination of properties.

The alloy of the present invention is a hot workable austenitic steel of superior pitting resistance to the chloride ion. It consists essentially of, by weight, from 19 to 23% chromium, 5 to 16% nickel, 3 to 5% molybdenum, 2.5 to 15% manganese, up to 0.01% sulfur, up to 0.1% of at least one element from the group consisting of cerium, calcium and magnesium, nitrogen from 0.2% up to its solubility limit, up to 0.1% carbon, up to 1% silicon, up to 3% copper, up to 1% columbium, up to 0.3% vanadium, up to 0.3% titanium, balance essentially iron.

Chromium, molybdenum and silicon are ferritizing elements. Chromium is added for oxidation and general corrosion resistances as well as for pitting resistance. Preferred levels of chromium are from 19.5 to 22%. Molybdenum must be present at a level of at least 3%, to impart sufficient pitting resistance to the chloride ion; insofar as the alloy is characterized by a weight loss of one part or less in 10,000, in a 72 hour room temperature 10% ferric chloride, 90% distilled water rubber band test. Preferred levels of molybdenum are from 3.5 to 4.5%. Silicon aids in the melting of the alloy. Levels of silicon are preferably kept below 0.75% as silicon is a ferritizer, and can render the alloy too fluid and thereby hinder welding.

As the alloy of the present invention is austenitic, the ferritizing effect of chromium, molybdenum, silicon and optional elements such as columbium, must be offset by austenitizing elements. The austenitizing elements of the subject alloy are nickel, manganese (up to a certain level), copper, nitrogen and carbon. In addition to serving as austenitizers, nickel, nitrogen and manganese contribute to the properties of the alloy. Nickel enhances the alloys impact strength, and is generally present in amounts of at least 8%. Preferred levels of nickel are from 9 to 13%. Nitrogen contributes to the alloys strength and enhances its pitting resistance. It is generally present in amounts of from 0.2 to 0.38%, and preferably at a level of from 0.23 to 0.33%. Manganese increases the alloys solubility for nitrogen, and in turn, its suitability for use where welding is involved. If the alloy is to be welded, it should have a manganese to nitrogen ratio of at least 20, and preferably, at least 25. Manganese levels are generally in excess of 7.5%, and preferably, from 8 to 13.5%. Carbon is preferably kept below 0.08% as it can cause intergranular corrosion in the weld-heat affected zone. In another embodiment, carbon is tied up with additions of stabilizing elements from the group consisting of columbium, vanadium and titanium. Such embodiments contain at least 0.1% of one or more of these elements. For increased resistance to sulfuric acid, the alloy can contain up to 3% copper. Copper containing embodiments will generally have at least 1% copper.

To enhance the hot workability of the subject alloy, sulfur is maintained at a level no higher than 0.01%, and preferably at a maximum level of 0.007%. Low sulfur is preferably attained through additions of cerium, calcium and/or magnesium. Alloys within the subject invention generally contain from 0.01 to 0.1% of said elements, and preferably from 0.014 to 0.1%. Cerium additions can be made through additions of Mischmetal. In addition to reducing sulfur levels, cerium, calcium and magnesium are believed to retard cold shortness, which gives rise to edge checks. Edge checks, which include edge and corner cracks and tears, are hot working defects which result from poor ductility, generally at the cold end of the hot working range.

The following examples are illustrative of several aspects of the invention.

EXAMPLE I

Two alloys (Alloys A and B) were annealed at 2050° F and subjected to a 72 hour room temperature 10% ferric chloride, 90% distilled water rubber band test. The chemistry of the alloys appears hereinbelow in Table I.

TABLE I

| Alloy | Chemistry (wt. %) | | | | | | | | | | |
|---|---|---|---|---|---|---|---|---|---|---|---|
| | Cr | Ni | Mo | Mn | S | Ca | Ce | N | Si | C | Fe |
| A | 20.05 | 3.75 | 3.75 | 8.40 | 0.004 | 0.010 | 0.004 | 0.29 | 0.33 | 0.050 | Bal. |
| B | 20.06 | 12.00 | 2.50 | 8.80 | 0.003 | 0.010 | 0.004 | 0.23 | 0.33 | 0.059 | Bal. |

Three samples of each alloy ($A_1$, $A_2$ and $A_3$ and $B_1$, $B_2$ and $B_3$) were subjected to the rubber band test. The results appear hereinbelow in Table II.

TABLE II

| Sample | Initial Weight (gms.) | Change In Weight (gms.) |
|---|---|---|
| $A_1$ | 16.0090 | 0.0000 |
| $A_2$ | 15.8452 | 0.0000 |
| $A_3$ | 15.9260 | 0.0000 |
| $B_1$ | 15.3272 | −0.0799 |
| $B_2$ | 15.5263 | −0.0903 |
| $B_3$ | 15.3220 | −0.0800 |

From Table II, it is clear that Alloy A samples had a weight loss of less than one part in 10,000 in the 3 day ferric chloride rubber band test, and that the Alloy B samples lost considerably more than one part in 10,000. Significantly, the Alloy A samples satisfy the chemistry requirements of the subject invention, whereas the Alloy B samples do not. The Alloy A samples have a molybdenum content in excess of 3%, whereas that for the Alloy B samples is below 3%.

EXAMPLE II

Two alloys (Alloys C and D) were Gleeble tested as follows: by heating to 2250° F in 10 seconds, holding for 1 minute, cooling to test temperatures at 5° F per second, holding for one second; and pulling to failure, to determine the ductility which might be observed in the lower end of the hot working range. The chemistry of the alloys appears hereinbelow in Table III.

TABLE III

| Alloy | Chemistry (wt. %) | | | | | | | | | | |
|---|---|---|---|---|---|---|---|---|---|---|---|
| | Cr | Ni | Mo | Mn | S | Ca | Ce | N | Si | C | Fe |
| C | 20.57 | 11.35 | 3.95 | 13.15 | 0.0027 | 0.009 | 0.010 | 0.33 | 0.53 | 0.051 | Bal. |
| D | 20.98 | 11.40 | 3.96 | 13.15 | 0.011 | 0.007 | 0.005 | 0.33 | 0.26 | 0.047 | Bal. |

The results of the Gleeble testing appear hereinbelow in Table IV.

TABLE IV

| Test Temperature (° F) | Reduction in Area (%) on Cooling From 2250° F to Test Temperature | |
|---|---|---|
| | Alloy C | Alloy D |
| 2000 | 66.6 | 55.0 |
| 1800 | 48.4 | 36.4 |
| 1800 | 48.4 | 38.2 |
| 1800 | 47.9 | 36.0 |
| 1600 | 45.0 | 36.7 |

From Table IV, it is clear that the hot workability of Alloy C is superior to that of Alloy D. Significantly, Alloy C satisfies the chemistry requirements of the subject invention, whereas Alloy D does not. Alloy C has a sulfur content below 0.01%, whereas that for Alloy D is in excess of 0.01%.

It will be apparent to those skilled in the art that the novel principles of the invention disclosed herein in connection with specific examples thereof will suggest various other modification and applications of the same. It is accordingly desired that in construing the breadth of the appended claims that they shall not be limited to the specific examples of the invention described herein.

We claim:

1. A hot workable austenitic stainless steel of superior pitting and crevice corrosion resistance to the chloride ion, consisting essentially of, by weight, from 19 to 23% chromium, 8 to 16% nickel, 3.5 to 4.5% molybdenum, 7.5 to 15% manganese, up to 0.01% sulfur, 0.01 to 0.1% of at least one element from the group consisting of cerium, calcium and magnesium, nitrogen from 0.2% up to its solubility limit, up to 0.1% carbon, up to 1% silicon, up to 3% copper, up to 1% columbium, up to 0.3% vanadium, up to 0.3% titanium, balance essentially iron; said steel being characterized by a weight loss of one part or less in 10,000, in a 72 hour room temperature 10% ferric chloride, 90% distilled water rubber band test.

2. A hot workable austenitic stainless steel according to claim 1, having from 19.5 to 22% chromium.

3. A hot workable austenitic stainless steel according to claim 1, having up to 0.38% nitrogen.

4. A hot workable austenitic stainless steel according to claim 3, having from 0.23 to 0.33% nitrogen.

5. A hot workable austenitic stainless steel according to claim 1, having from 9 to 13% nickel.

6. A hot workable austenitic stainless steel according to claim 1, having from 8 to 13.5% manganese.

7. A hot workable austenitic stainless steel according to claim 1, having manganese and nitrogen present in a manganese to nitrogen ratio of at least 20.

8. A hot workable austenitic stainless steel according to claim 7, having manganese and nitrogen present in a manganese to nitrogen ratio of at least 25.

9. A hot workable austenitic stainless steel according to claim 1, having from 0.01 to 0.1% of at least one element from the group consisting of cerium and calcium.

10. A hot workable austenitic stainless steel according to claim 1, having at least 0.014% of at least one element from the group consisting of cerium, calcium and magnesium.

11. A hot workable austenitic stainless steel according to claim 1, having up to 0.007% sulfur.

12. A hot workable austenitic stainless steel according to claim 1, having at least 0.1% of at least one element from the group consisting of columbium, vanadium and titanium.

13. A hot workable austenitic stainless steel according to claim 1, having at least 1% copper.

14. A hot workable austenitic stainless steel according to claim 1, having up to 0.38% nitrogen; said steel's manganese and nitrogen being present in a manganese to nitrogen ratio of at least 20.

15. A hot workable austenitic stainless steel according to claim 14, having from 19.5 to 22% chromium, 9 to 13% nickel, 3.5 to 4.5% molybdenum, 8 to 13.5% manganese, 0.23 to 0.33% nitrogen, up to 0.08% carbon and up to 0.75% silicon; said manganese and nitrogen being present in a manganese to nitrogen ratio of at least 25.

* * * * *